US006835515B2

(12) United States Patent
Tong et al.

(10) Patent No.: US 6,835,515 B2
(45) Date of Patent: Dec. 28, 2004

(54) LONG POTLIFE, LOW TEMPERATURE CURE OVERCOAT FOR LOW SURFACE ENERGY PHOTORECEPTORS

(75) Inventors: Yuhua Tong, Webster, NY (US); John F. Yanus, Webster, NY (US); William W. Limburg, Penfield, NY (US); Timothy J. Fuller, Pittsford, NY (US); Dale S. Renfer, Webster, NY (US); Markus R. Silvestri, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/371,782

(22) Filed: Feb. 21, 2003

(65) Prior Publication Data

US 2004/0166427 A1 Aug. 26, 2004

(51) Int. Cl.[7] ..... G03G 5/147
(52) U.S. Cl. ..... 430/66; 430/59.6; 430/132
(58) Field of Search ..... 430/66, 59.6, 132

(56) References Cited

U.S. PATENT DOCUMENTS 5,510,432 A 4/1996 Schmalstieg et al.
5,521,272 A 5/1996 O'Connor et al.
5,556,971 A 9/1996 Bay et al.
5,688,598 A 11/1997 Keck et al.
5,702,854 A 12/1997 Schank et al.
6,010,810 A * 1/2000 Uesaka et al. ..... 430/58.8
6,071,659 A 6/2000 Renfer et al.
6,087,464 A 7/2000 Swarup et al.
6,096,470 A 8/2000 Fuller et al.
6,132,913 A 10/2000 Fuller et al.
6,139,999 A 10/2000 Fuller et al.
6,197,464 B1 3/2001 Dinh et al.
6,207,334 B1 3/2001 Dinh et al.
6,340,719 B1 1/2002 Goeb et al.
6,361,913 B1 3/2002 Pai et al.
6,383,699 B1 5/2002 Yuh et al.
6,437,077 B1 * 8/2002 Danner ..... 528/73
6,448,363 B1 9/2002 Wenning et al.
6,451,717 B1 9/2002 Fitzgerald et al.
6,686,031 B2 * 2/2004 Matsufuji et al. ..... 428/212

* cited by examiner

*Primary Examiner*—John L Goodrow
(74) *Attorney, Agent, or Firm*—Maginot, Moore & Beck

(57) ABSTRACT

A composition is provided for coating a photoreceptor having a charge generating layer and a charge transport layer. The composition includes a hole transport material, a cross-linkable film forming binder having at least one functional group that is reactive with isocyanate, a blocked isocyanate cross-linking agent and a solvent having a boiling point equal to or below the deblocking temperature. The blocked isocyanate cross-linking agent is the reaction product of an isocyanate and a blocking agent, wherein the blocking agent has a boiling point temperature equal to or below a selected deblocking temperature to allow the isocyanate to form cross-links. The invention also provides an electrophotographic imaging member with an overcoat layer comprising a cross-linked film forming binder, an isocyanate compound, a hole transport material, and optionally a surface energy reducing agent. Processes for making the imaging members are also provided.

18 Claims, 8 Drawing Sheets

Methyl ethyl ketoxime blocked 4,4'-methylenebis(phenyl isocyanate)

Methyl ethyl ketoxime blocked tolylene 2,4-diisocyanate

2-Methylimidazole blocked tolylene 2,4-diisocyanate

2-Methylimidazole blocked 1,6-diisocyanatohexane 3,5-dimethylpyrazole blocked 1,6-diisocyanatohexane 3,5-dimethylpyrazole blocked tolylene 2,4-diisocyanate 3,5-dimethylpyrazole blocked 3-(triethoxysilyl)propyl isocyanate

LONG POTLIFE, LOW TEMPERATURE CURE OVERCOAT FOR LOW SURFACE ENERGY PHOTORECEPTORS

BACKGROUND OF THE INVENTION

This invention relates generally to electrophotographic imaging members and, more specifically, to layered photoreceptor structures with improved overcoat layers and processes for making the imaging members.

Electrophotographic imaging members, i.e. photoreceptors, typically include a photoconductive layer formed on an electrically conductive substrate. The photoconductive layer is an insulator in the dark so that electric charges can be retained on its surface. Upon exposure to light, the charge is dissipated.

An electrostatic latent image is formed on the photoreceptor by first uniformly depositing an electric charge over the surface of the photoconductive layer by one of the many known means in the art. The photoconductive layer functions as a charge storage capacitor with charge on its free surface and an equal charge of opposite polarity on the conductive substrate. A light image is then projected onto the photoconductive layer. The portions of the layer that are not exposed to light retain their surface charge. After development of the latent image with toner particles to form a toner image, the toner image is usually transferred to a receiving member, such as paper.

Many advanced imaging systems are based on the use of small diameter photoreceptor drums. The use of such small diameter drums places a premium on photoreceptor life. A major factor limiting photoreceptor life in copiers and printers is wear. The use of small diameter drum photoreceptors exacerbates the wear problem because, for example, 3 to 10 revolutions are required to image a single letter size page. Multiple revolutions of a small diameter drum photoreceptor to reproduce a single letter size page can require up to 1 million cycles from the photoreceptor drum to obtain 100,000 prints, a desirable goal for commercial systems.

For low volume copiers and printers, bias charging rolls (BCR) are desirable because little or no ozone is produced during image cycling. However, the micro corona generated by the BCR during charging damages the photoreceptor, resulting in rapid wear of the imaging surface, e.g., the exposed surface of the charge transport layer. For example, wear rates can be as high as about 16 micrometers per 100,000 imaging cycles. Similar problems are encountered with bias transfer roll (BTR) systems.

One common type of photoreceptor is a multi-layered device that comprises a conductive layer, a blocking layer, an adhesive layer, a charge generating layer, and a charge transport layer. The charge transport layer may contain an active aromatic diamine molecule, which enables charge transport, dissolved or molecularly dispersed in a film forming binder. A charge transport layer of this type is disclosed in U.S. Pat. No. 4,265,990, the disclosure of which is incorporated herein by reference. Another type of charge transport layer has been developed that employs a charge transporting polymer wherein the charge transporting moiety is incorporated in the polymer as a group pendant from the backbone of the polymer backbone or as a moiety in the backbone of the polymer. These types of charge transporting polymers include poly (N-vinylcarbazole), polysylenes, and others.

One approach to achieving longer photoreceptor drum life is to form a protective overcoat on the imaging surface, e.g.

the charge transporting layer of a photoreceptor. This overcoat layer must satisfy many requirements, including transporting holes, resisting image deletion, resisting wear and avoidance of perturbation of underlying layers during coating. Although various hole transporting small molecules can be used in overcoating layers, one of the toughest known overcoatings includes cross-linked polyamide (e.g. Luckamide) containing N,N'-diphenyl-N,N'-bis(3-hydroxyphenyl)-[1,1'-biphenyl]-4,4'-diamine. This overcoat is described in U.S. Pat. No. 5,368,967, the entire disclosure thereof being incorporated herein by reference.

Durable photoreceptor overcoatings containing cross-linked polyamide (e.g. Luckamide) and N,N'-diphenyl-N,N'-bis(3-hydroxyphenyl)-[1,1'-biphenyl]-4,4'-diamine (DHTBD) have been prepared using oxalic acid and trioxane to improve photoreceptor life by at least a factor of 3 to 4. The improved wear resistance involved cross-linking of Luckamide under heat treatment, e.g. 110° C.–120° C. for about 30 minutes. However, adhesion of this overcoat to certain photoreceptor charge transport layers, containing certain polycarbonates (e.g., Z-type 300) and charge transport materials [e.g., bis-N,N-(3,4-dimethylphenyl)-N-(4-biphenyl)amine and N,N'-diphenyl-N,N'-bis(3-methylphenyl)-[1,1'-biphenyl]-4,4'-diamine] is greatly reduced under such drying conditions. On the other hand, under drying conditions of below about 110° C., the overcoat adhesion to the charge transport layer was good, but the overcoat had a high rate of wear. Thus, there was an unacceptably small drying condition window for the overcoat to achieve the targets of both adhesion and wear rate.

One known long-life overcoat formulation depends upon acid catalyzed condensation of N-methoxy-methyl groups and N—H units. This overcoat formulation can be a self-condensation of Luckamide, which contains both units, or a cross-linking agent, such as hexamethoxymethylmelamine (commercial name Cymel 303) plus Luckamide or Elvamide (the latter two materials being alcohol soluble nylon polyamides). While these formulations have beneficial wear properties, they suffer from certain drawbacks, including limited pot life. In addition, the acid catalyst at optimum concentration can degrade the electrical properties of the photoreceptor layers. Moreover, there is no effective method to chemically bond surface energy reducing components into the overcoat composition to improve the performance of the overcoat with certain toners.

In spite of the many improvements, there remains an urgent need for an effective, wear resistant overcoat. Since the drums are typically dip coated, one of the requirements for the overcoat material is ease and economical synthesis of materials and a coating solution pot life of several weeks. Pot life is the life of the coating composition without changes in its properties so that the same mixture can be used for several weeks. With coating compositions that ultimately cross-link and provide wear protection, there is a danger of initiation of cross-linking in the pot itself rendering the remaining material in the pot useless. Since the unused material must be discarded and the pot cleaned or replaced, this waste of material and effort has a significant negative impact on the manufacturing cost.

In U.S. Pat. No. 5,702,854 to Schank et al., issued Dec. 30, 1998, an electrophotographic imaging member is disclosed including a supporting substrate coated with at least a charge generating layer, a charge transport layer and an overcoating layer, said overcoating layer comprising a dihydroxy arylamine dissolved or molecularly dispersed in a cross-linked polyamide matrix. The overcoating layer is formed by cross-linking a cross-linkable coating composition including a polyamide containing methoxy methyl groups attached to amide nitrogen atoms, a cross-linking catalyst and a dihydroxy amine, and heating the coating to cross-link the polyamide. The electrophotographic imaging member may be imaged in a process involving uniformly charging the imaging member, exposing the imaging member with activating radiation in image configuration to form an electrostatic latent image, developing the latent image with toner particles to form a toner image, and transferring the toner image to a receiving member.

U.S. Pat. No. 5,681,679, issued to Schank, et al. on Oct. 28, 1997, discloses a flexible electrophotographic imaging member including a supporting substrate and a resilient combination of at least one photoconductive layer and an overcoating layer, the at least one photoconductive layer comprising a hole transporting arylamine siloxane polymer and the overcoating comprising a cross-linked polyamide doped with a dihydroxy amine. This imaging member may be utilized in an imaging process including forming an electrostatic latent image on the imaging member, depositing toner particles on the imaging member in conformance with the latent image to form a toner image, and transferring the toner image to a receiving member.

SUMMARY OF THE INVENTION

It is, therefore, an object of the present invention to provide overcoat compositions with longer pot life. It is another object of the invention to provide overcoat compositions that do not require an acid catalyst.

Yet another object of the present invention to provide overcoat compositions that include surface energy reducing agents. It is another object of the invention to provide overcoats that resist wear.

The foregoing objects and others are accomplished in accordance with this invention by providing a composition for coating a photoreceptor having a charge generating layer and a charge transport layer, the composition comprising a hole transport material; a cross-linkable film forming binder having at least one functional group that is reactive with isocyanate; a blocked isocyanate cross-linking agent that is the reaction product of an isocyanate and a blocking agent; wherein the blocking agent has a boiling point temperature equal to or below a selected deblocking temperature to allow the isocyanate to form cross-links; and a solvent having a boiling point equal to or below the deblocking temperature. In addition, the compositions of this invention optionally include a surface energy reducing agent.

The invention also provides an electrophotographic imaging member comprising a substrate; a charge generating layer; a charge transport layer; and an overcoat layer. The overcoat layer includes a cross-linked film forming binder, an isocyanate compound, a hole transport material and optionally, a cross-linked surface energy reducing agent.

The electrographic imaging member of this invention may be fabricated by forming a coating solution according to this invention; forming a coating with the coating solution on a photoreceptor having a charge generating layer and a charge transport layer, and heating the coating to the deblock temperature, the deblock temperature equal to or higher than a boiling point of the solvent to form an overcoat layer.

DETAILED DESCRIPTION

Figure 1:
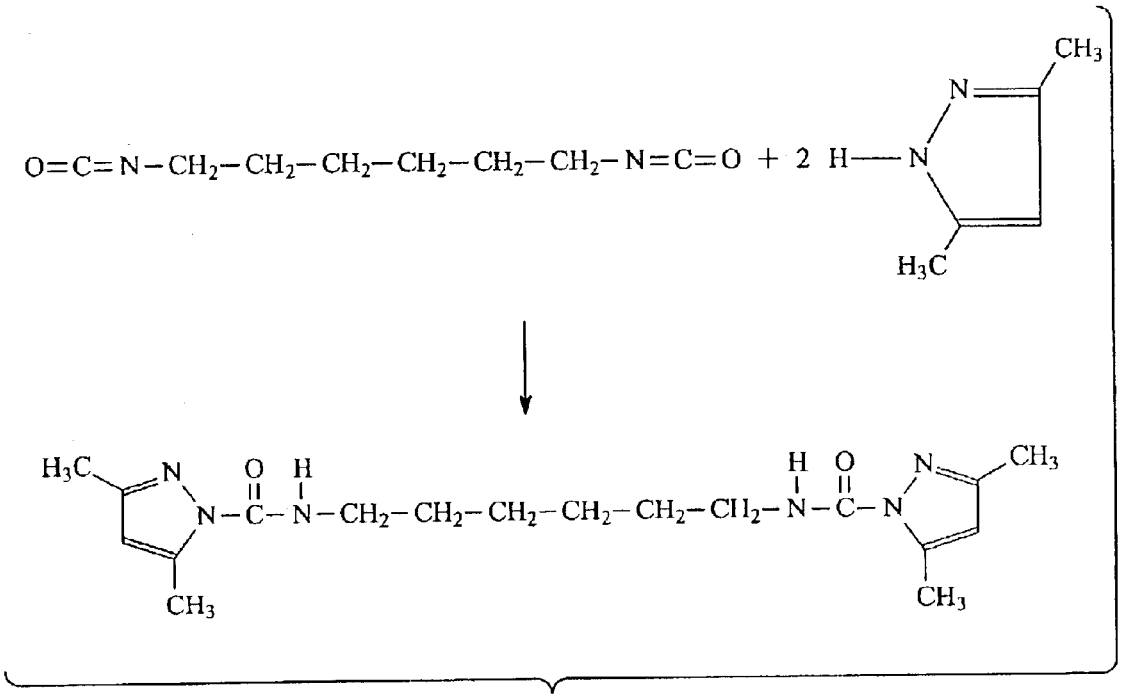
FIG. 1 illustrates the synthesis of 2,4-dimethylpyrazole blocked 1,6-diisocyanatohexane.

For the purposes of promoting an understanding of the principles of the invention, reference will now be made to the embodiments illustrated in the drawings and specific language will be used to describe the same. It will nevertheless be understood that no limitation of the scope of the invention is thereby intended. The invention includes any alterations and further modifications in the illustrated devices and described methods and further applications of the principles of the invention that would normally occur to one skilled in the art to which the invention relates.

The present invention provides electrographic imaging members having improved overcoats, compositions that may be employed as coating solutions to fabricate overcoats for electrographic imaging members and methods for making electrographic imaging members. One aspect of the invention is the use of isocyanate cross-linking agents in overcoating compositions. The isocyanate cross-linking agents make it possible to avoid the use of acid catalysts while increasing pot life and incorporating surface energy reducing agents into the overcoats.

Electrophotographic imaging members are well known in the art and may be prepared by any suitable technique. Typically, a flexible or rigid substrate is provided with an electrically conductive surface. A charge generating layer is then applied to the electrically conductive surface. A charge blocking layer may optionally be applied to the electrically conductive surface prior to the application of a charge generating layer. If desired, an adhesive layer may be utilized between the charge blocking layer and the charge generating layer. Usually the charge generation layer is applied onto the blocking layer and a charge transport layer is formed on the charge generation layer. This structure may have the charge generation layer on top of or below the charge transport layer.

The substrate may be opaque or substantially transparent and may comprise any suitable material having the required mechanical properties. Accordingly, the substrate may comprise a layer of an electrically non-conductive or conductive material such as an inorganic or an organic composition. Various resins may be employed as non-conductive materials, including polyesters, polycarbonates, polyamides, polyurethanes, and the like, which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, a sheet and the like.

The thickness of the substrate layer depends on numerous factors, including strength desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors. Accordingly, for a flexible photo-responsive imaging device, the thickness of the conductive coating may be between about 20 angstroms to about 750 angstroms, and more preferably from about 100 angstroms to about 200 angstroms for an optimum combination of electrical conductivity, flexibility and light transmission. The flexible conductive coating may be an electrically conductive metal layer formed, for example, on the substrate by any suitable coating technique, such as a vacuum depositing technique or electro-deposition. Typical metals include aluminum, zirconium, niobium, tantalum, vanadium and hafnium, titanium, nickel, stainless steel, chromium, tungsten, molybdenum, and the like.

An optional hole blocking layer may be applied to the substrate. Any suitable and conventional blocking layer capable of forming an electronic barrier to holes between the adjacent photoconductive layer and the underlying conductive surface of a substrate may be utilized.

An optional adhesive layer may be applied to the hole blocking layer. Any suitable adhesive layer may be utilized and such adhesive layer materials are well known in the art. Typical adhesive layer materials include, for example, polyesters, polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

At least one electrophotographic imaging layer is formed on the adhesive layer, blocking layer or substrate. The electrophotographic imaging layer may be a single layer that performs both charge generating and charge transport functions, as is well known in the art, or it may comprise multiple layers such as a charge generator layer and charge transport layer. Charge generator layers may comprise amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition. The charge generator layers may also comprise inorganic pigments of crystalline selenium and its alloys; Group II-VI compounds; and organic pigments such as quinacridones, polycyclic pigments such as dibromo anthanthrone pigments, perylene and perinone diamines, polynuclear aromatic quinones, azo pigments including bis-, tris- and tetrakisazos; and the like dispersed in a film forming polymeric binder and fabricated by solvent coating techniques.

Phthalocyanines have been employed as photo-generating materials for use in laser printers utilizing infrared exposure systems. Infrared sensitivity is required for photoreceptors exposed to low cost semiconductor laser diode light exposure devices. The absorption spectrum and photosensitivity of the phthalocyanines depend on the central metal atom of the compound. Many metal phthalocyanines have been reported and include, oxyvanadium phthalocyanine, chloroaluminum phthalocyanine, copper phthalocyanine, oxytitanium phthalocyanine, chlorogallium phthalocyanine, hydroxygallium phthalocyanine magnesium phthalocyanine and metal-free phthalocyanine. The phthalocyanines exist in many crystal forms, which have a strong influence on photo-generation.

Any suitable polymeric film forming binder material may be employed as the matrix in the charge generating (photogenerating) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrenealkyd resins, polyvinylcarbazole, and the like. These polymers may be block, random or alternating copolymers.

The photo-generating composition or pigment is present in the resinous binder composition in various amounts. Generally, however, from about 5 percent by volume to about 90 percent by volume of the photo-generating pigment is dispersed in about 10 percent by volume to about 95 percent by volume of the resinous binder, and preferably from about 20 percent by volume to about 30 percent by volume of the photo-generating pigment is dispersed in about 70 percent by volume to about 80 percent by volume of the resinous binder composition. In one embodiment about 8 percent by volume of the photo-generating pigment is dispersed in about 92 percent by volume of the resinous binder composition. The photo-generator layers can also fabricated by vacuum sublimation in which case there is no binder.

Any suitable and conventional technique may be utilized to mix and thereafter apply the photo-generating layer coating mixture. Typical application techniques include spraying, dip coating, roll coating, wire wound rod coating, vacuum sublimation and the like. For some applications, the generator layer may be fabricated in a dot or line pattern. Removing of the solvent of a solvent coated layer may be effected by any suitable conventional technique such as oven drying, infrared radiation drying, air drying and the like.

The charge transport layer may comprise a charge transporting material (CTM) dissolved or molecularly dispersed in a film forming electrically inert polymer such as a polycarbonate. The term "dissolved" as employed herein is defined herein as forming a solution in which the CTM is dissolved in the polymer to form a homogeneous phase. The expression "molecularly dispersed" is used herein is defined as a CTM dispersed in the polymer, the small molecules being dispersed in the polymer on a molecular scale. Any suitable charge transporting or electrically active small molecule may be employed in the charge transport layer of this invention. The expression CTM is defined herein as a monomer that allows the free charge photo-generated in the transport layer to be transported across the transport layer. Typical CTMs include, for example, pyrazolines such as 1-phenyl-3-(4'-diethylamino styryl)-5-(4"-diethylamino phenyl)pyrazoline, diamines such as N,N'-diphenyl-N,N'-bis(3-methylphenyl)-(1,1'-biphenyl)-4,4'-diamine, hydrazones such as N-phenyl-N-methyl-3-(9-ethyl)carbazyl hydrazone and 4-diethyl amino benzaldehyde-1,2-diphenyl hydrazone, and oxadiazoles such as 2,5-bis(4-N,N'-diethylaminophenyl)1,2,4-oxadiazole, stilbenes and the like. A CTM compound that permits injection of holes from the charge generating layer into the charge transport layer with high efficiency and then transports them across the charge transport layer with very short transit times is N,N'-diphenyl-N,N'-bis(3-methylphenyl)-(1,1'-biphenyl)-4,4'-diamine. If desired, the charge transport material in the charge transport layer may comprise a polymeric charge transport material or a combination of a small molecule charge transport material and a polymeric charge transport material.

Any suitable electrically inactive resin binder may be employed in the charge transport layer of this invention. Typical inactive resin binders include polycarbonate resin, polyester, polyarylate, polyacrylate, polyether, polysulfone, and the like. Molecular weights can vary, for example, from about 20,000 to about 150,000. Preferred binders include polycarbonates such as poly(4,4'-isopropylidene-diphenylene)carbonate (also referred to as bisphenol-A-polycarbonate, polycarbonate, poly(4,4'-cyclohexylidinediphenylene)carbonate (referred to as bisphenol-Z polycarbonate), poly(4,4'-isopropylidene-3,3'-dimethyl-diphenyl)carbonate (also referred to as bisphenol-C-polycarbonate) and the like. Any suitable charge transporting polymer may also be utilized in the charge transporting layer of this invention.

Any suitable technique may be utilized to mix and thereafter apply the charge transport layer coating mixture onto the charge generating layer. Typical application techniques include spraying, dip coating, roll coating, wire wound rod coating, and the like. Drying of the deposited coating may be effected by any suitable conventional technique such as oven drying, infrared radiation drying, air drying and the like.

Generally, the thickness of the charge transport layer is between about 10 and about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layers is preferably maintained from about 2:1 to 200:1 and in some instances as great as 400:1. The charge transport layer is substantially non-absorbing to visible light or radiation in the region of intended use.

The invention provides a composition for coating an overcoat onto the photoreceptor. The compositions of this invention include a hole transport material, a cross-linkable film forming binder having at least one functional group that is reactive with isocyanate, a blocked isocyanate cross-linking agent that is the reaction product of an isocyanate and a blocking agent, wherein the blocking agent has a boiling point temperature equal to or below a selected deblocking temperature to allow the isocyanate to form cross-links; a solvent having a boiling point equal to or below the deblocking temperature, and optionally, a cross-linkable surface energy reducing agent having at least one functional group that is reactive with isocyanate.

The film forming binder for the overcoating composition may be any suitable compound that is soluble in the solvent and that has at least one functional group that is reactive with isocyanate. Functional groups that are reactive with isocyanate include, for example, hydroxyl groups, amino groups and thiol groups. Examples of film forming binders that are suitable include polyvinyl butyral, polyesters, epoxy resins, phenoxy resins and other similar compounds. Preferably, the binder is a hole insulating film forming alcohol soluble polymer, such as polyvinyl butyral.

The expression "polyvinyl butyral", as employed herein, is defined as a copolymer or terpolymer obtained from the hydrolysis of polyvinyl acetate to form polyvinyl alcohol or a copolymer of polyvinyl alcohol with residual vinyl acetate groups, the resulting polyvinyl alcohol polymer being reacted with butyraldehyde under acidic conditions to form polyvinyl butyral polymers with various amounts of acetate, alcohol and butyraldehyde ketal groups. These polyvinyl butyral polymers are commercially available from, for example, Solutia Inc. with the trade names: BMS, BLS, BL I, B79, B99, and the like. These polymers differ in the amount of acetate, hydroxy, and butyraldehyde ketal groups contained therein. Generally, the weight average molecular weights of polyvinyl butyral film forming polymers vary from about 36000 to about 98000. Preferably, the weight average molecular weight of the polyvinyl butyral utilized in the process of this invention is between about 40,000 and about 250,000. This polymer is described in U.S. Pat. No. 5,418,107, the entire disclosure thereof being incorporated herein by reference.

The invention contemplates any suitable isocyanate compound. Preferably, the isocyanate is a multi-functional isocyanate, which is capable of rapidly cross-linking the binder and the surface energy reducing agent. Since isocyanates will react almost instantaneously with the solvent as well as any —OH group containing components, the pot life will be nearly zero unless the isocyanates are blocked.

The term "blocked isocyanate" is used herein to mean the reaction products of an isocyanate and a blocking agent, wherein the blocking agent is removable from the isocyanate under increased thermal conditions. In other words, the term "blocked" as applied herein to isocyanates means temporarily unreactive due to a thermally-reversible masking of the isocyanate functionality through reaction with a suitable blocking agent.

The blocked isocyanate cross-linking agents of this invention can be derived from the reaction products of a free di- and poly-isocyanates and isocyanate blocking agents. In preferred embodiments, the isocyanate is a diisocyanate represented by the formula:

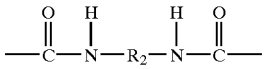

wherein $R_2$ is selected from the group consisting of $C_1$–$C_6$ alkyl, $C_1$–$C_6$ alkenyl, phenyl $C_1$–$C_6$ alkyl, phenyl, $NO_2$—, halogen and a carboxylate group. In one particular embodiment, the isocyanate is hexane diisocyanate.

The blocking agent can be selected from those materials that react with the functional groups of the isocyanate to form stable adducts at room temperature to block cross-linking reactions with the hydroxyl groups of the resin components, but which can be disassociated at an elevated temperature to reproduce free isocyanate groups. Standard methods can be used to prepare the blocked isocyanates, for example by biuretization, dimerization, trimerization, urethanization, and uretidionization of the starting monomeric isocyanates. Examples of suitable blocking agents include lactams, such as caprolactam and butyrolactam, lower alcohols, such as methanol, ethanol, and isobutyl alcohol, oximes, such as methyl ethyl ketoxime and cyclohexanone oxime, phenols, such as phenol, p-t-butyl phenol and cresol, and pyrazoles, such as 3,5-dimethylpyrazole, and the like.

In preferred embodiments of this invention, the blocked isocyanate cross-linking agent is a diisocyanate represented by the formula:

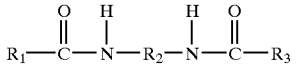

wherein $R_2$ is selected from the group consisting of $C_1$–$C_6$ alkyl, $C_1$–$C_6$ alkenyl, phenyl $C_1$–$C_6$ alkyl, phenyl, $NO_2$—, halogen or a carboxylate group; and $R_1$ and $R_3$ are independently selected from $C(R_4)$═N—O—; and

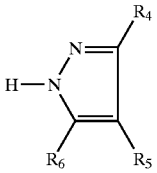

wherein $R_4$, $R_5$, $R_6$ is independently selected from hydrogen, $C_1$–$C_4$ alkyl, $C_1$–$C_4$ alkenyl, phenyl $C_1$–$C_4$ alkyl, phenyl, $NO_2$—, halogen or a carboxylate group.

The preferred blocked isocyanate cross-linking agent is 3,5-dimethylpyrazole blocked 1,6-diisocyanatohexane. The synthesis of this agent is illustrated in FIG. 1.

Any suitable solvent may be employed for the film forming binder. Typical alcohol solvents include, for example, butanol, propanol, methanol, and the like and mixtures thereof. Another suitable solvent is tetrahydrofuran.

Any suitable hole transport material may be utilized in the overcoating layer of this invention. Preferably, the hole transport material is an alcohol soluble polyhydroxy triarylamine small molecule charge transport material having at least two hydroxy functional groups. An especially preferred small molecule hole transporting material can be represented by the following formula:

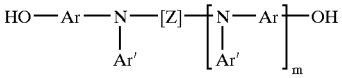

wherein:

m is 0 or 1,

Z is selected from the group consisting of:

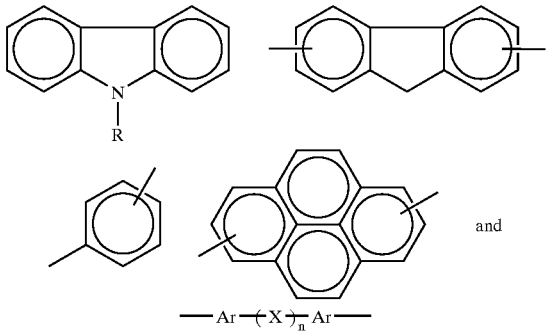

n is 1 or 1,

Ar is selected from the group consisting of:

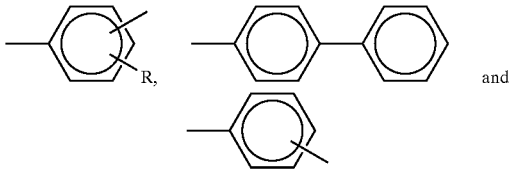

R is selected from the group consisting of —$CH_3$, —$C_2H_5$, —$C_3H_7$, and —$C_4H_9$, Ar' is selected from the group consisting of:

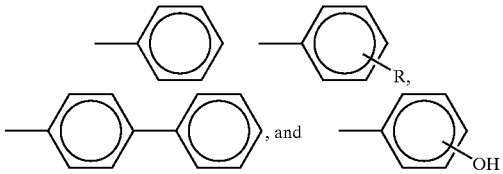

X is selected from the group consisting of:

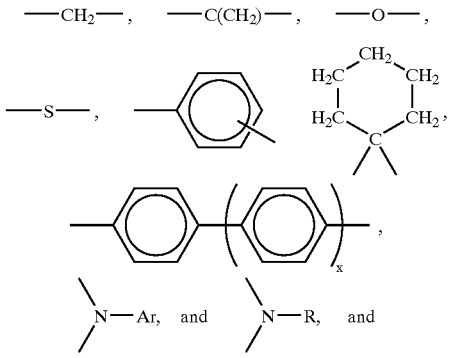

s is 0, 1 or 2, the dihydroxy arylamine compound being free of any direct conjugation between the —OH groups and the nearest nitrogen atom through one or more aromatic rings.

The expression: direct conjugation" is defined as the presence of a segment, having a formula:

$$-(C{=}C)_n-C{=}C-$$

in one or more aromatic rings directly between an —OH group and the nearest nitrogen atom. Examples of direct conjugation between the —OH groups and the nearest nitrogen atom through one or more aromatic rings include a compound containing a phenylene group having an —OH group in the ortho or para position (or 2 or 4 position) on the phenylene group relative to a nitrogen atom attached to the phenylene group or a compound containing a polyphenylene group having an —OH group in the ortho or para position on the terminal phenylene group relative to a nitrogen atom attached to an associated phenylene group.

Typical polyhydroxy arylamine compounds utilized in the overcoat of this invention include, for example: N,N'-diphenyl-N,N'-bis(3-hydroxyphenyl)-[1,1'-biphenyl]-4,4'-diamine; N,N,N',N',-tetra(3-hydroxyphenyl)-[1,1'-biphenyl]-4,4'-diamine; N,N-di(3-hydroxyphenyl)-m-toluidine; 1,1-bis-[4-(di-N,N-3-hydroxyphenyl)-aminophenyl]-cyclohexane; 1,1-bis[4-(N-m-hydroxyphenyl)-4-(N-phenyl)aminophenyl]-cyclohexane; bis-(N-(3-hydroxyphenyl)-N-phenyl-4-aminophenyl)-methane; bis[(N-(3-hydroxyphenyl)-N-phenyl)-4-aminophenyl]-isopropylidene; N,N'-diphenyl-N,N'-bis(3-hydroxyphenyl)[1,1'4',1"-terphenyl]-4,4"-diamine; 9-ethyl-3,6-bis[N-phenyl-N-3(3-hydroxyphenyl)-amino]-carbazole; 2,7-bis[N,N-di(3-hydroxyphenyl)-amino]-fluorene; 1,6-bis [N,N-di(3-hydroxyphenyl)-amino]-pyrene.

One of the surprising advantages of the present invention is that it allows surface energy reducing components to be incorporated into the overcoat. Before the present invention, there was no known effective method to chemically bond surface energy reducing components within the overcoat. Such surface energy releasing components or release agents are desirable for use with certain toners, such as emulsion aggregate toners. The release agents of this invention have at least one functional group that is reactive with isocyanate. In preferred embodiments, the release agent is a silicone compound, and most preferably a hydroxy-polydimethyl siloxane.

In one embodiment, the composition for coating a photoreceptor comprises a hole transport material present in an amount between about eighty percent (80%) by weight and about twenty percent (20%) by weight, the cross-linkable film forming binder present in an amount between about twenty percent (20%) by weight and about eighty percent (80%) by weight, the blocked isocyanate cross-linking agent present in an amount about eight percent (8%) by weight and the surface energy reducing agent present in an amount about 0.5 percent (0.5%) by weight based on the total weight of the composition.

All the components utilized in the overcoating solution of this invention should be soluble in the solvents employed for the overcoating. When at least one component in the overcoating mixture is not soluble in the solvent utilized, phase separation can occur which would adversely affect the transparency of the overcoating and electrical performance of the final photoreceptor.

The overcoatings of this invention may be fabricated using the processes of this invention. In one embodiment, the process includes forming a coating solution or a composition of this invention, which comprises a solvent, a hole transporting material, a cross-linkable film forming binder, (optionally) a surface energy reducing agent and a blocked isocyanate cross-linking agent. The blocked isocyanate cross-linking agent is the reaction product of an isocyanate and a blocking agent wherein the blocking agent has a boiling point equal to or below a selected deblocking temperature to allow the isocyanate to form cross-links. The next steps in the processes are to form a coating with the coating solution on a photoreceptor having a charge generating layer and a charge transport layer, and then to heat the coating to the deblock temperature, the deblock temperature equal to or higher than a boiling point of the solvent to form an overcoat layer.

The bonds between the isocyanate and the blocking agent are reversible at some elevated temperature. Blocking prevents unwanted irreversible reactions with moisture and other reactive functional groups within the composition and contaminants. By using a volatile blocking agent, heating the blocked isocyanate will unblock the isocyanate by evaporating the blocking agent leaving the unblocked isocyanate to react with functional groups within the composition thereby forming cross-links.

One benefit of the present invention is that the compositions can be cured at low temperatures. Since some carrier generation layers are electrically altered at higher temperatures, it is an advantage to cure at lower temperatures. In the processes of the present invention, the coating is heated at a temperature of between about 100° C. and about 150° C. In a most preferred embodiment employing 3,5-dimethylpyrazole blocked 1,6-diisocyanatohexane, curing can be accomplished at 110° C. This temperature is ideal since all of a methanol or THF solvent can be easily removed at a temperature below the deblock temperature. At the same time, this temperature is sufficiently high so that coating solutions will be stable over a prolonged period of time. The curing temperature is adjustable by the addition of a catalyst, such as an amine. However, acid catalysts are not preferred.

Generally, the degree of cross-linking selected depends upon the desired flexibility of the final photoreceptor. For example, complete cross-linking may be used for rigid drum or plate photoreceptors. However, partial cross-linking is preferred for flexible photoreceptors having, for example, web or belt configurations. The degree of cross-linking can be controlled by the relative amount of the blocked isocyanate cross-linking agent. After cross-linking, the overcoating should be substantially insoluble in the solvent in which it was soluble prior to cross-linking. Thus, no overcoating material will be removed when rubbed with a cloth soaked in the solvent.

The thickness of the continuous overcoat layer selected depends upon the abrasiveness of the charging (e.g., bias charging roll), cleaning (e.g., blade or web), development (e.g., brush), transfer (e.g., bias transfer roll), etc., in the system employed and can range up to about 10 micrometers. A thickness of between about 1 micrometer and about 5 micrometers in thickness is preferred. Any suitable and conventional technique may be utilized to mix and thereafter apply the overcoat layer coating mixture to the charge transport layer. Typical application techniques include spraying, dip or roll coating, wire wound rod coating, and the like. Drying of the deposited coating may be effected by any suitable conventional technique such as oven drying, infrared radiation drying, air drying and the like. The dried overcoating of this invention should transport holes during imaging and should not have too high a free carrier concentration. Free carrier concentration in the overcoat increases the dark decay. Preferably the dark decay of the overcoated layer should be about the same as that of the non-overcoated device.

In accordance with one aspect of the invention, an electrophotographic imaging member can include a substrate, a charge generating layer and a charge transport layer, with an overcoat layer comprising a cross-linked film forming binder, an isocyanate compound and a hole transport material. In a preferred embodiment, the overcoat layer comprises between about twenty percent (20%) by weight and about eighty percent (80%) by weight of the film forming binder and between about twenty percent (20%) by weight and about eight percent (8%) by weight of the isocyanate compound, based on the total weight of the overcoat layer.

In another embodiment, the wherein the overcoat layer comprises between about twenty percent (20%) by weight and about eighty percent (80% 0 by weight of the film forming binder and between about one percent (1%) by weight and about twenty-five percent (25%) by weight of the isocyanate compound and about 0.5 percent (0.5%) by weight surface energy reducing agent, based on the total weight of the overcoat layer.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE 1

Figure 2:
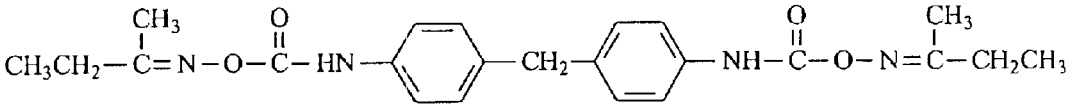
FIGS. 2 and 3 illustrate structural formulas for examples of blocked isocyanates prepared according to this invention.
Figure 2:
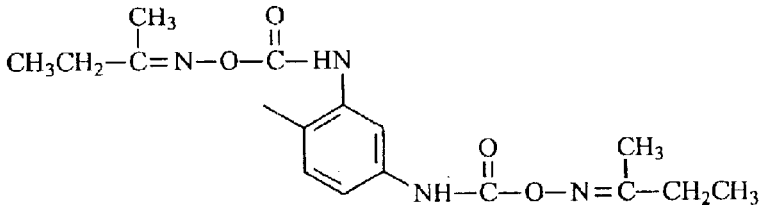
Figure 2:
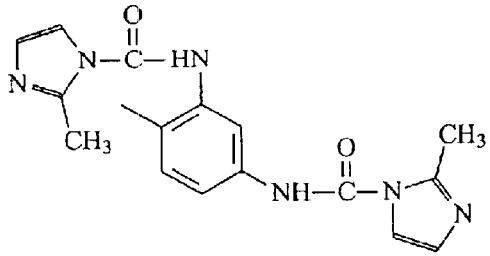
Figure 2:
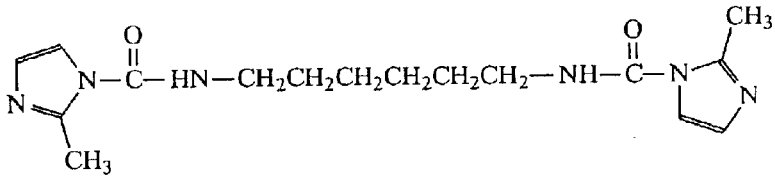
Figure 2:
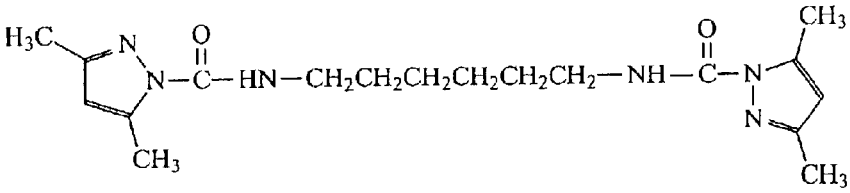
Figure 3:
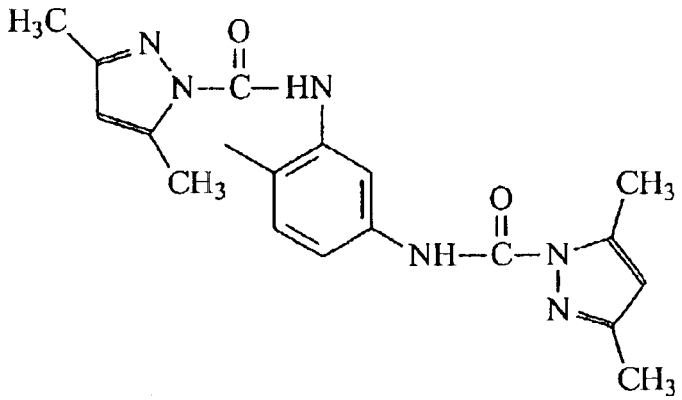
Figure 3:
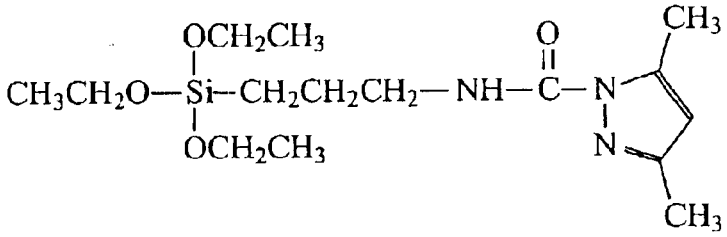
Figure 4:
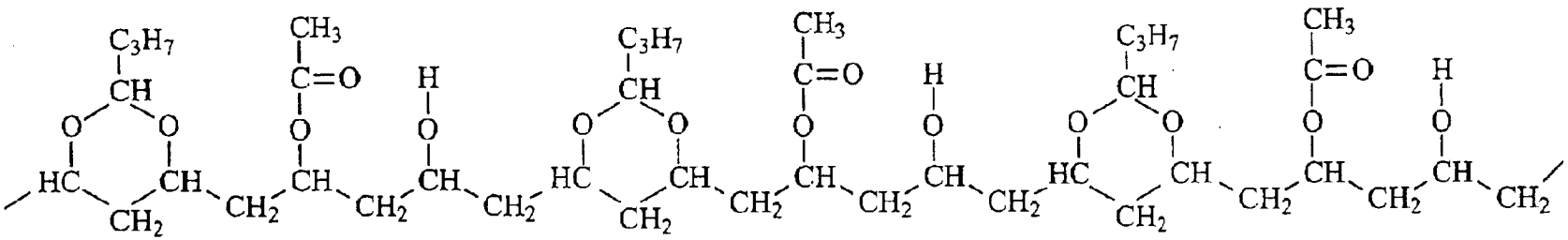
FIG. 4 illustrates a structural formula of a polyvinylbutyral segment.

Blocked isocyanates were prepared by the reaction of the isocyanate group with an active hydrogen compound upon heating in the presence of a nucleophile. The blocked isocyanates are shown in FIGS. 2 and 3. These blocked isocyanates have curing temperatures from about 100° C. to about 155° C.

EXAMPLE 2

A coating composition comprising the compounds shown in FIGS. 4–7 prepared in an alcohol solvent. The composition was coated onto a Galaxy photoreceptor and heated to a temperature about 110° C. to form an overcoat layer (FIG. 8). The overcoat layer was hard and slippery.

EXAMPLE 3

Figure 5:
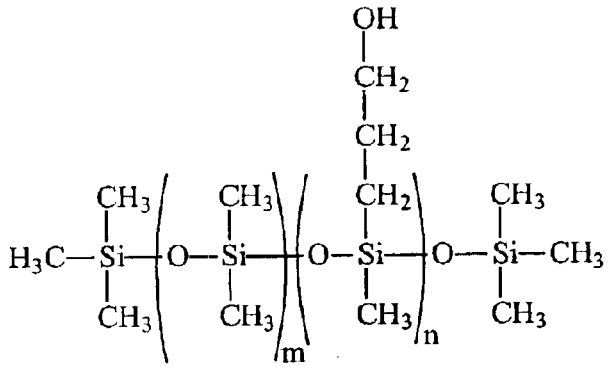
FIG. 5 illustrates a structural formula of a hydroxy-PDMS molecule.
Figure 6:
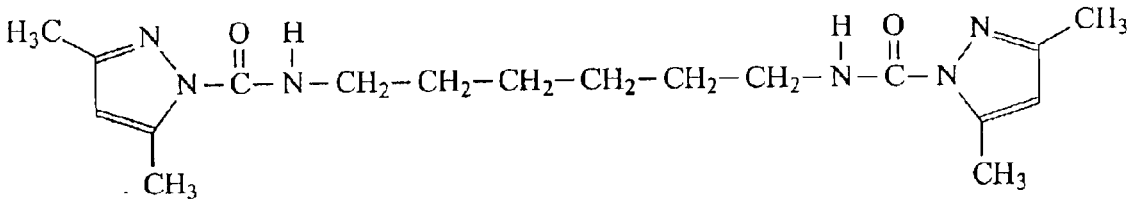
FIG. 6 illustrates a structural formula for 3,5-dimethylpyrazole blocked toluene 2,4-diisocyante.
Figure 7:
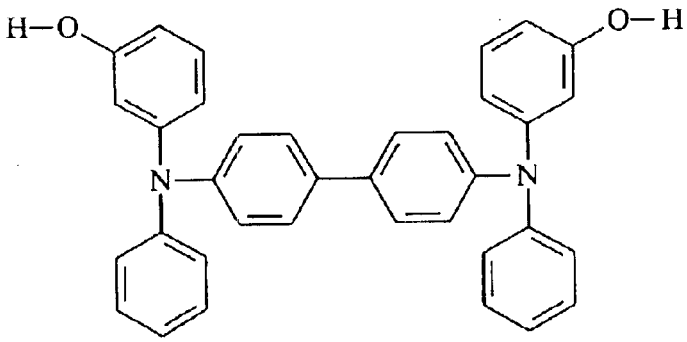
FIG. 7 illustrates a structural formula for dihydroxybiphenyldiamine.
Figure 8:
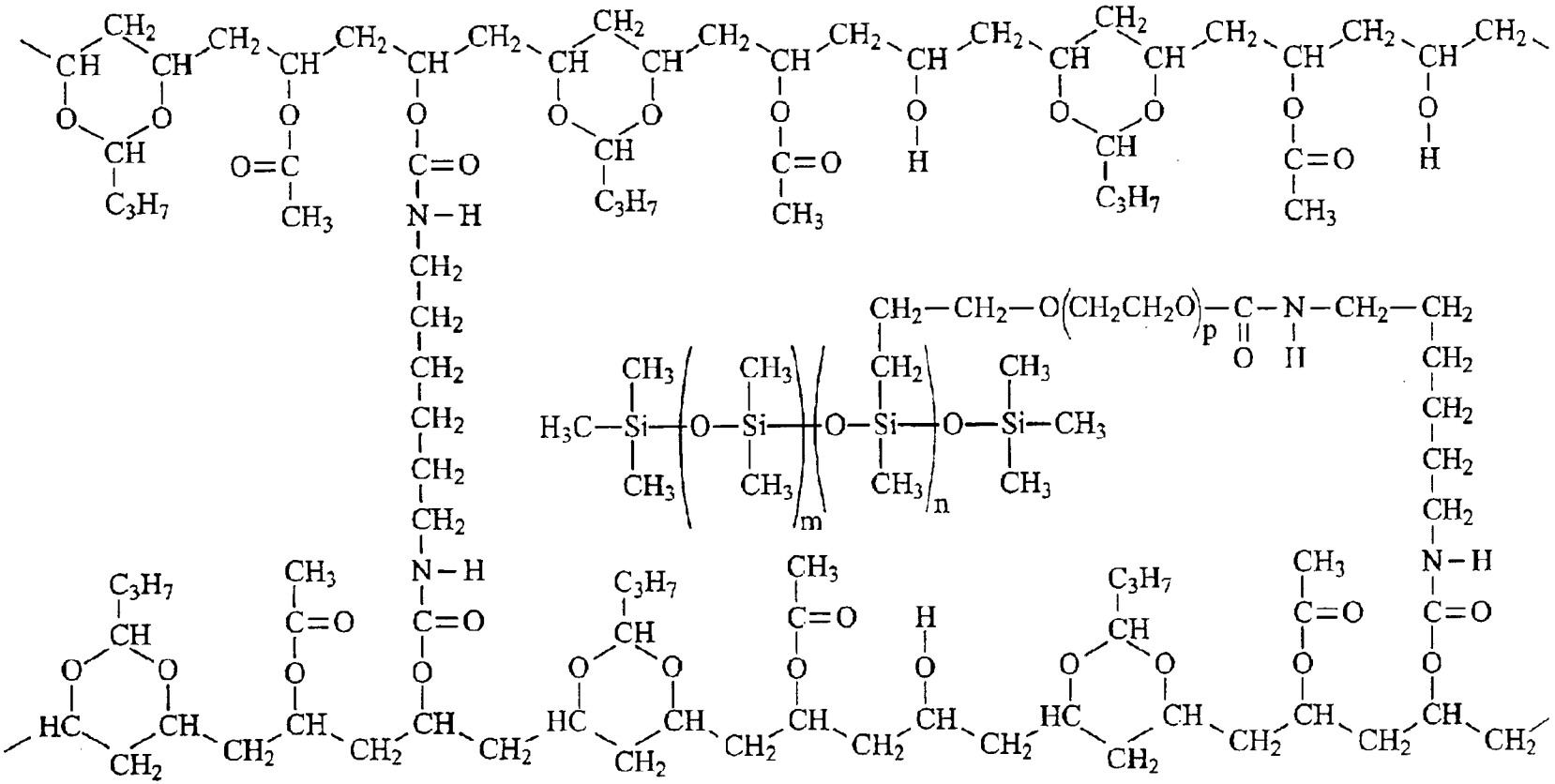
FIG. 8 illustrates a structural formula for a cured overcoat according to one embodiment of this invention.
Figure 9:
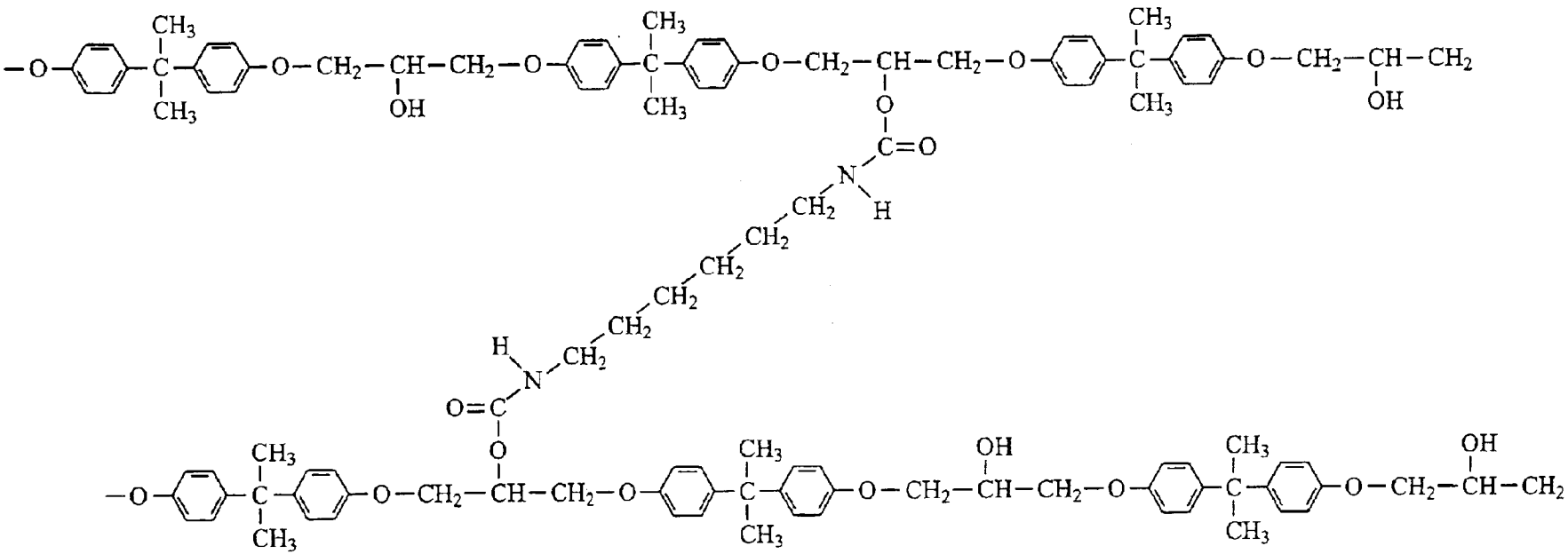
FIG. 9 illustrates a structural formula for a cured overcoat according to another embodiment of this invention.

A coating composition comprising an epoxy resin and the compounds illustrated in FIGS. 5–7 was prepared in a tetrahydrofuran (THF) solvent. The composition was coated onto a flexible belt photoreceptor device and heated to a temperature about 110° C. to form an overcoat layer (FIG. 9). The overcoat layer was hard and slippery. To test the wear resistance of the overcoat, the overcoat layer was repeatedly rubbed with Q-Tips. The overcoat was impervious. A puddle of THF was aggressively rubbed with the wooden end of a Q-Tip with only slight damage.

EXAMPLE 4

Figure 10:
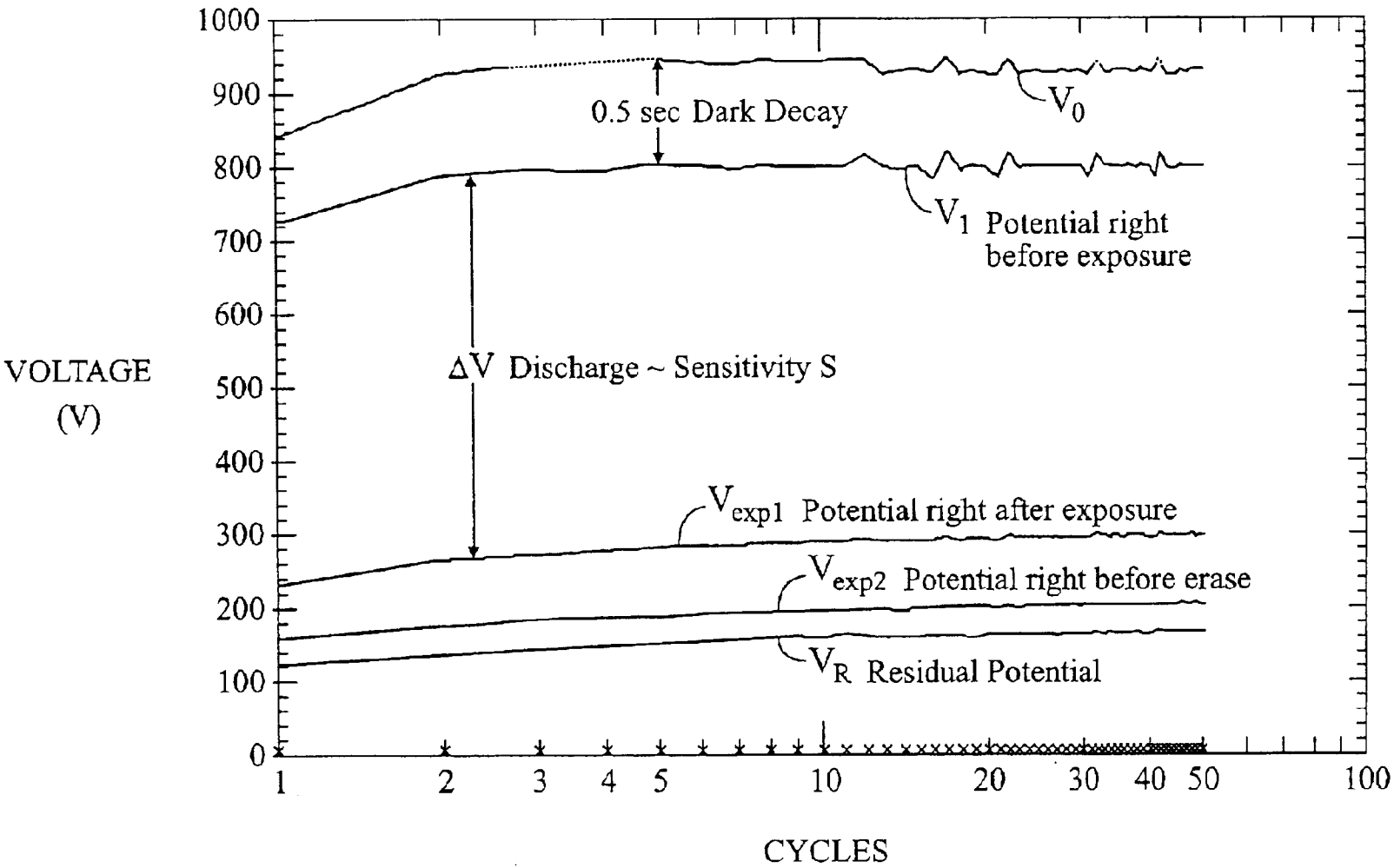
FIG. 10 shows electrical data from Example 3.

The overcoat layer of Example 3 was analyzed for electrical properties. The prepared devices were electrically tested with a cyclic scanner set to obtain 100 charge-erase cycles immediately followed by an additional 100 cycles, sequences at 2 charge-erase cycles, and 1 charge-expose-erase cycle, wherein the light intensity was incrementally increased with cycling to produce a photo-induced discharge curve from which the photosensitivity was measured. The scanner was equipped with a scorotron set to a constant voltage charging at various surface potentials. The devices were tested at surface potentials of 350, 500, 650, and 800 volts with the exposure light intensity incrementally increased by means of regulating a series of neutral density filters, and the exposure light source was a 780 nanometer light emitting diode. The drum was rotated at a speed of 61 revolutions per minute to produce a surface speed of 25 inches per second or a cycle time of 0.984 per second. The entire xerographic simulation was carried out in an environmentally controlled light tight chamber at ambient conditions, forty percent relative humidity and 22 degrees Celsius. An excellent PIDC was obtained. The data is shown in FIG. 10 and indicates that the photoreceptor with this inventive overcoat exhibited very stable electrical properties.

EXAMPLE 5

A solution of 0.8 g 3,5-dimethylpyrazole blocked 1,6-diisocyanatohexane, 3.5 g of Luckamide, 4.5 g of DHTBD, 1.5 g polyvinyl butyral (MB-S), 16 g methanol and 16 g 1-propanol was coated as an overcoat on a Galaxy full devoice photoreceptor and cured at 110° C. for 45 minutes. The device had a very slippery surface. In the electrical test, the device showed very good charge acceptance, low and stable dark decay, good sensitivity and low and stable residual with no cycle up.

EXAMPLE 6

A solution of 16.7 g THF, 3.3 g epoxy resin EPON1009, 1.75 g DHTBD, 1.75 g M-TBD and 0.6 g of 3,5-dimethylpyrazole blocked 1,6-diisocyanatohexane formed a clear solution. The solution was coated on a device and cured at 135° C. for 35 minutes. The surface was very slippery and showed good adhesion to CTL.

Although the invention has been described with reference to specific preferred embodiments, it is not intended to be limited thereto, rather those having ordinary skill in the art will recognize that variations and modifications may be made therein which are within the spirit of the invention and within the scope of the claims.

What is claimed is:

1. A low temperature curing composition for coating a photoreceptor having a charge generating layer and a charge transport layer, the composition comprising:

a hole transport material;

a cross-linkable film forming binder having at least one functional group that is reactive with isocyanate;

a blocked isocyanate cross-linking agent that is the reaction product of an isocyanate and a blocking agent; wherein the blocking agent has a boiling point equal to or below a selected deblocking temperature to a flow the isocyanate to form cross-links; and a solvent having a boiling point equal to or below the deblocking temperature.

2. A composition according to claim 1, further comprising a cross-linkable surface energy reducing agent having at least one functional group that is reactive with isocyanate.

3. A composition according to claim 2 wherein said surface energy reducing agent is a silicone compound.

4. A composition according to claim 3 wherein said surface energy reducing agent is a hydroxy-polydimethyl siloxane.

5. A composition according to claim 1 wherein said blocked isocyanate cross-linking agent comprises at least one dimethyl pyrazole blocked isocyanate.

6. A composition according to claim 1 wherein said blocked isocyanate cross-linking agent is a diisocyanate represented by the formula:

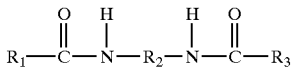

wherein $R_2$ is selected from the group consisting of $C_1$–$C_4$ alkyl, $C_1$–$C_6$ alkenyl, phenyl $C_1$–$C_6$ alkyl, phenyl, $NO_2$—, halogen or a carboxylate group; and $R_1$ and $R_3$ are independently selected from $C(R_4)$=N—O—; and

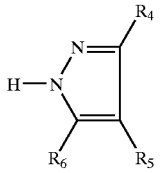

wherein $R_4$, $R_5$, $R_6$ is independently selected from hydrogen, $C_1$–$C_6$ alkyl, $C_1$–$C_6$ alkenyl, phenyl $C_1$–$C_6$ alkyl, phenyl, $NO_2$—, halogen or a carboxylate group.

7. A composition according to claim 1 wherein said blocked isocyanate cross-linking agent is 3,5-dimethylpyrazole blocked 1,6-diisocyanatohexane.

8. A composition according to claim 1 wherein the hole transport material is present in an amount between about eighty percent (80%) by weight and about twenty percent (20%) by weight, the cross-linkable film forming binder is present in an amount between about twenty percent (20%) by weight and about twenty percent (80%) by weight and the isocyanate cross-linking agent is present in an amount about eight percent (8%) by weight based on the total weight of the composition.

9. A composition according to claim 1 wherein said film forming binder is an alcohol soluble, multihydroxyl group-containing binder.

10. A composition according to claim 9 wherein said film forming binder is selected from the group consisting of polyvinyl butyral, polyesters, epoxy resins and phenoxy resins.

11. A composition according to claim 1 wherein said hole transport material is an alcohol soluble polyhydroxy triarylamine.

12. A composition according to claim 11 wherein the hole transport material is an alcohol soluble N,N'-diphenyl-N,N'-bis(3-hydroxyphenyl)-[1,1-biphenyl]-4,4'-diamine.

13. A process comprising forming a low temperature curing coating solution, the coating solution comprising a solvent, a hole transporting material, a cross-linkable film forming binder, and a blocked isocyanate cross-linking agent, the blocked isocyanate cross-linking agent that is the reaction product of an isocyanate and a blocking agent wherein the blocking agent has a boiling point equal to or below a selected deblocking temperature to allow the isocyanate to form cross-links; and forming a coating with the coating solution on a photoreceptor having a charge generating layer and a charge transport layer, and heating the coating to the deblock temperature, the deblock temperature equal to or higher than a boiling point of the solvent to form an overcoat layer.

14. A process according to claim 13 wherein the coating composition further comprises a surface energy reducing agent.

15. A process according to claim 13 wherein the solvent is selected from the group consisting of THF, methanol, ethanol, butanol and mixtures thereof.

16. A process according to claim 13 wherein the heating comprises heating the coating at a temperature between about 100° C. and about 150° C.

17. A process according to claim 16 wherein the heating comprises heating the coating at a temperature of about 110° C.

18. A process according to claim 13 wherein the coating solution is substantially free of an acid catalyst.

* * * * *